US007080795B2

(12) United States Patent
Chen

(10) Patent No.: US 7,080,795 B2
(45) Date of Patent: Jul. 25, 2006

(54) PATTERN SWITCHING DEVICE FOR GARDEN NOZZLES

(75) Inventor: Yann-Shoou Chen, Hsinchu (TW)

(73) Assignee: Ho-Chin Chen, Taichung Hsien (TW)

( * ) Notice: Subject to any disclaimer, the term of this patent is extended or adjusted under 35 U.S.C. 154(b) by 149 days.

(21) Appl. No.: 10/962,462

(22) Filed: Oct. 13, 2004

(65) Prior Publication Data

US 2005/0274826 A1 Dec. 15, 2005

(30) Foreign Application Priority Data

Jun. 10, 2004 (TW) ..... 93209170 U

(51) Int. Cl.
*A62C 31/02* (2006.01)

(52) U.S. Cl. ..... 239/394; 239/526; 239/586

(58) Field of Classification Search ..... 239/526, 239/442, 443, 394, 395, 397, 586
See application file for complete search history.

(56) References Cited

U.S. PATENT DOCUMENTS

| | | | | |
|---|---|---|---|---|
| 1,703,219 | A * | 2/1929 | Wold | 239/415 |
| 3,380,705 | A * | 4/1968 | Enssle | 251/89 |
| 4,903,897 | A * | 2/1990 | Hayes | 239/394 |
| 4,909,443 | A * | 3/1990 | Takagi | 239/440 |

* cited by examiner

*Primary Examiner*—Christopher Kim
(74) *Attorney, Agent, or Firm*—Bacon & Thomas

(57) ABSTRACT

A garden nozzle includes a barrel and a handle to be connected with a hose and a tube is movably received in the barrel and connected with a pattern switching button which is connected to the handle. A shank with a spiral groove extends through a pattern member rotatably mounted to a front end of the barrel and a sleeve which is received in the tube. The pattern member is fixed to the shank. The sleeve includes a ridge which is movably engaged with the spiral groove so that when pulling the pattern switching button, the tube and the sleeve are moved backward so as to drive the shank and the pattern member to rotate.

6 Claims, 8 Drawing Sheets

PATTERN SWITCHING DEVICE FOR GARDEN NOZZLES

FIELD OF THE INVENTION

The present invention relates to a garden nozzle with a pattern switching button on the handle so as to change patterns of watering by one hand only.

BACKGROUND OF THE INVENTION

A conventional garden nozzle is disclosed in FIG. 1 and generally includes a barrel 10 with a handle 11 through which a path 111 is defined so as to be connected with a hose which is not shown. A rod 12 is movably extended into the barrel 10 from a rear end of the barrel 10 and a lever 15 is connected to the rod so as to pull the rod 12 backward. A collar 13 is engaged with an opening of the main path 112 in the barrel 10 and a pattern member 14 is rotatably mounted to a front end of the barrel 10. A positioning device 16 including a bead and a spring is used to index the position of the pattern member 14 which further includes an outlet 141 which is in communication with one of the pattern holes in the pattern member 14 and the main path 112. When pulling the rod 12 backward by operating the lever 15, the front end of the rod 12 is removed from the collar 13 so as to allow water eject from the outlet 141. It is an inherent shortcoming that the user has to hold the handle 11 by one hand and rotate the pattern member 14 by the other hand. If the user rotates the pattern member 14 during watering, water stream hits the hand of the user and splashes the user.

The present invention intends to provide a pattern switching button for rotate the pattern member and the button is located on the handle of the nozzle so that the user can operate the button by the hand holding the handle.

SUMMARY OF THE INVENTION

The present invention relates to garden nozzle which comprises a barrel and a handle is connected to the barrel. The handle includes a path which communicates with a pipe in the barrel. A trigger is pivotably connected to the handle and has a valve engaged with the path. A pattern switching button is movably connected to the handle. A pattern member is rotatably mounted to a front end of the barrel and a shaft has a first end fixed to the pattern member and a spiral groove is defined in an outer periphery of a shank of the shaft. A tube is movably mounted to the shank and a spring is biased between one end of the tube and an inside of the barrel. Two holes are defined through a wall of the tube and a first pawl and a second pawl are respectively and pivotably engaged with the two holes. The pattern switching button is connected to and moved with the tube.

A sleeve is mounted to the shank and received in the tube. A ridge extends from an inner periphery of the sleeve and is movably engaged with the groove in the shank. Two recesses are defined in an outer periphery of the sleeve and the first and second pawls are engaged with the recesses respectively. The second pawl has a side wing extending outward therefrom which is pushed by a protrusion in the barrel to pivot the second pawl away from the recess when the tube is moved by pulling the pattern switching button.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
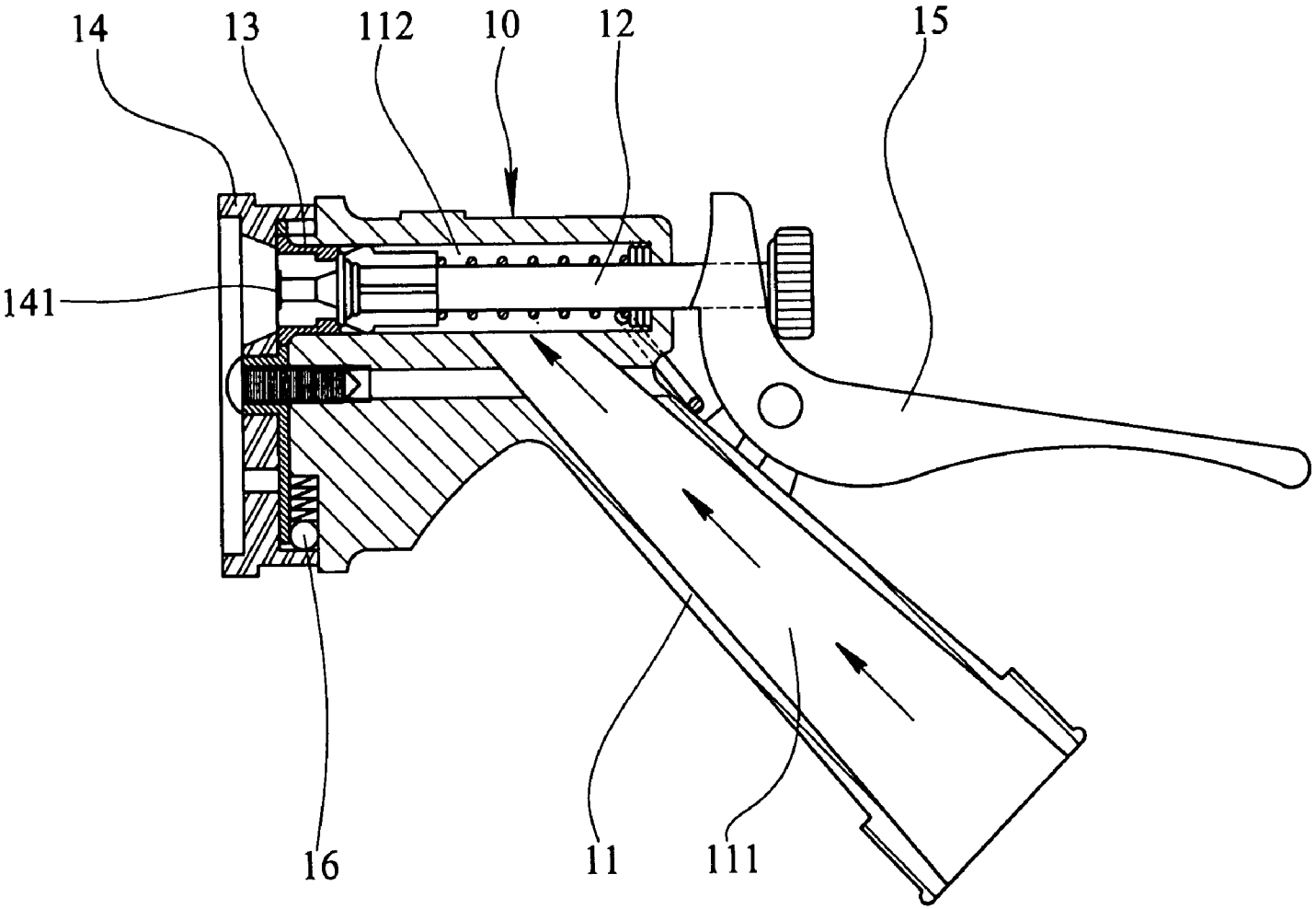
FIG.1 PRIOR ART
FIG. 1 is a side cross sectional view to show a conventional garden nozzle.
Figure 2:
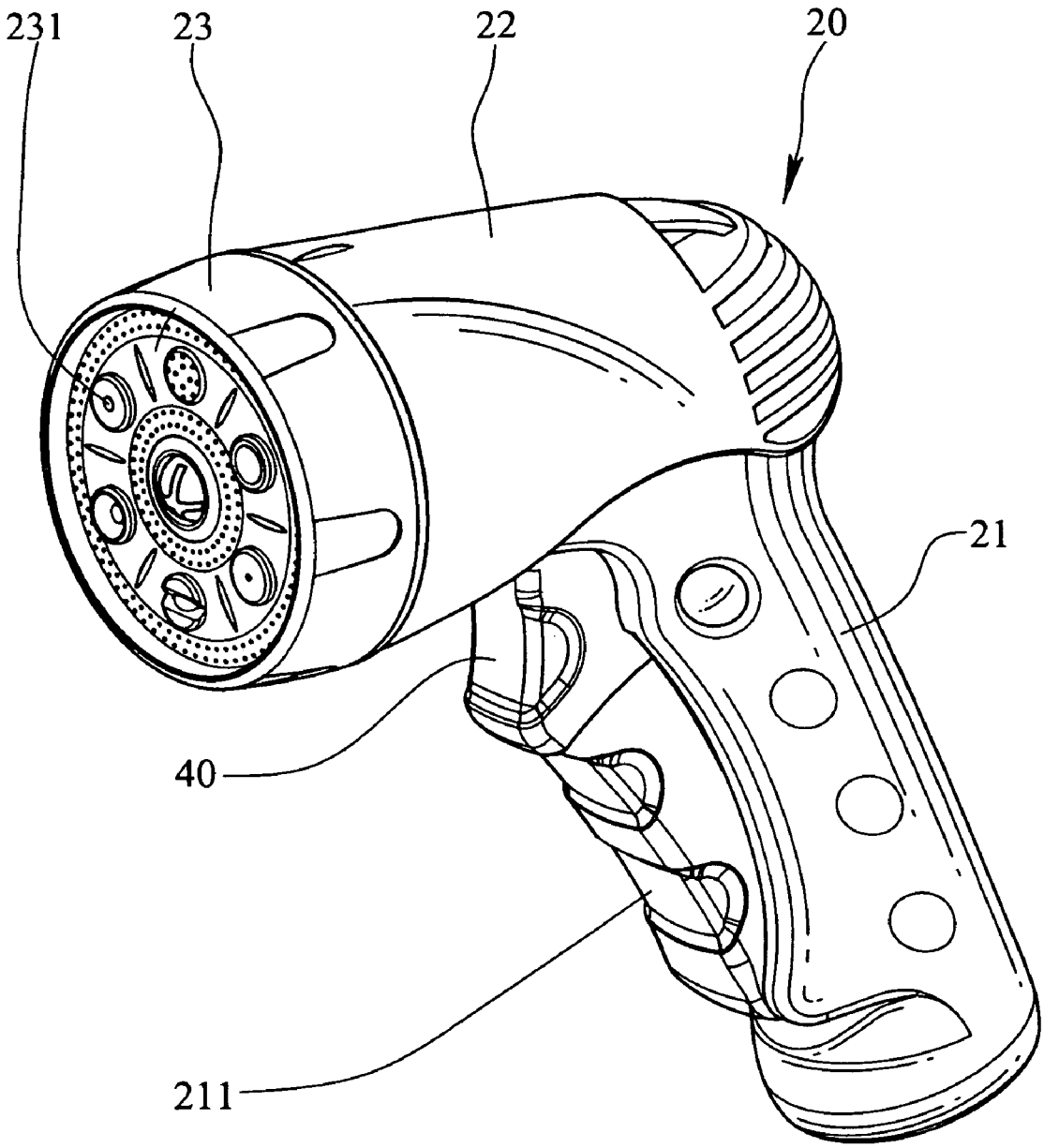
FIG. 2 shows the garden nozzle of the present invention.
Figure 3:
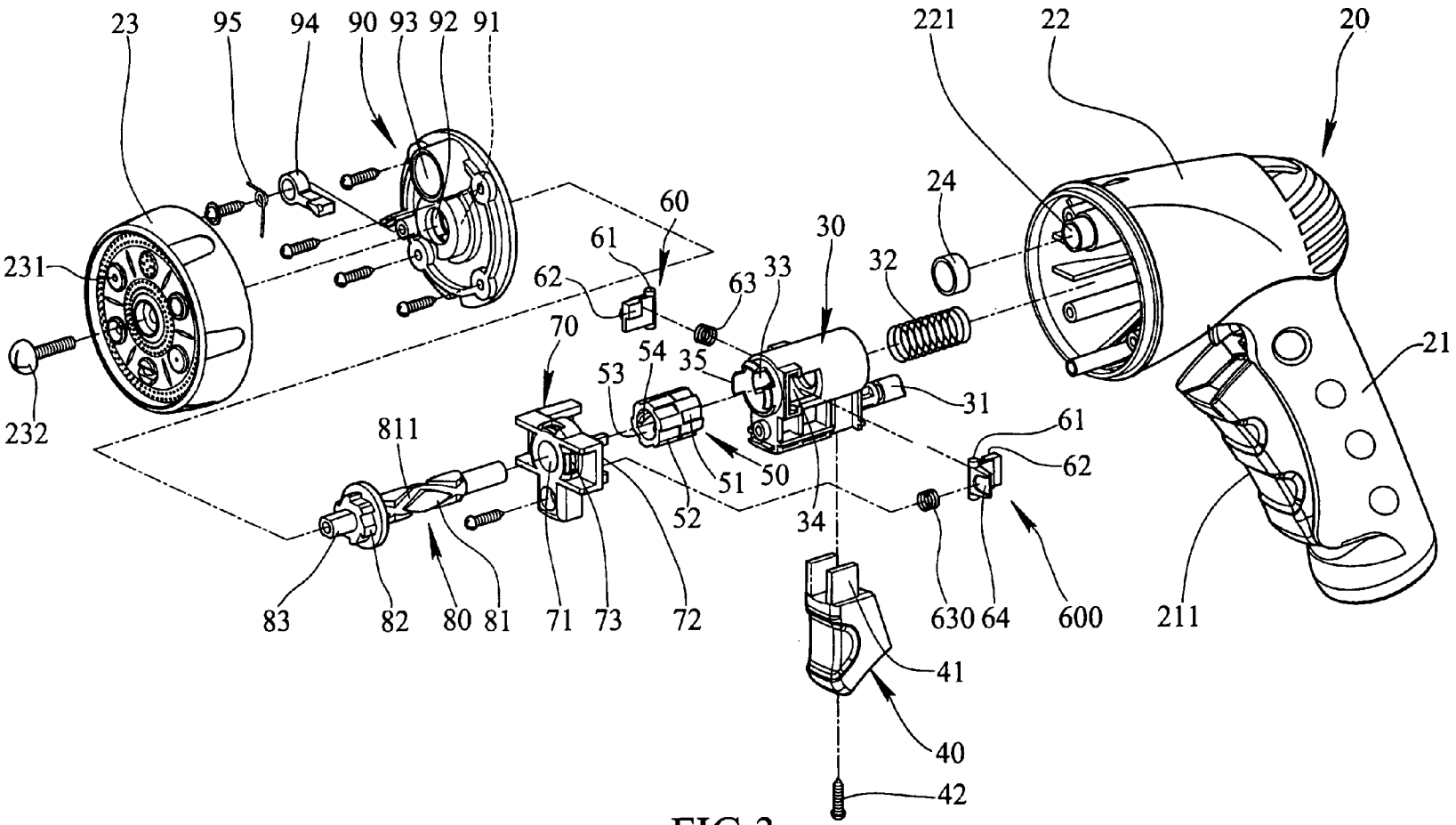
FIG. 3 is an exploded view to show the garden nozzle of the present invention.
Figure 4:
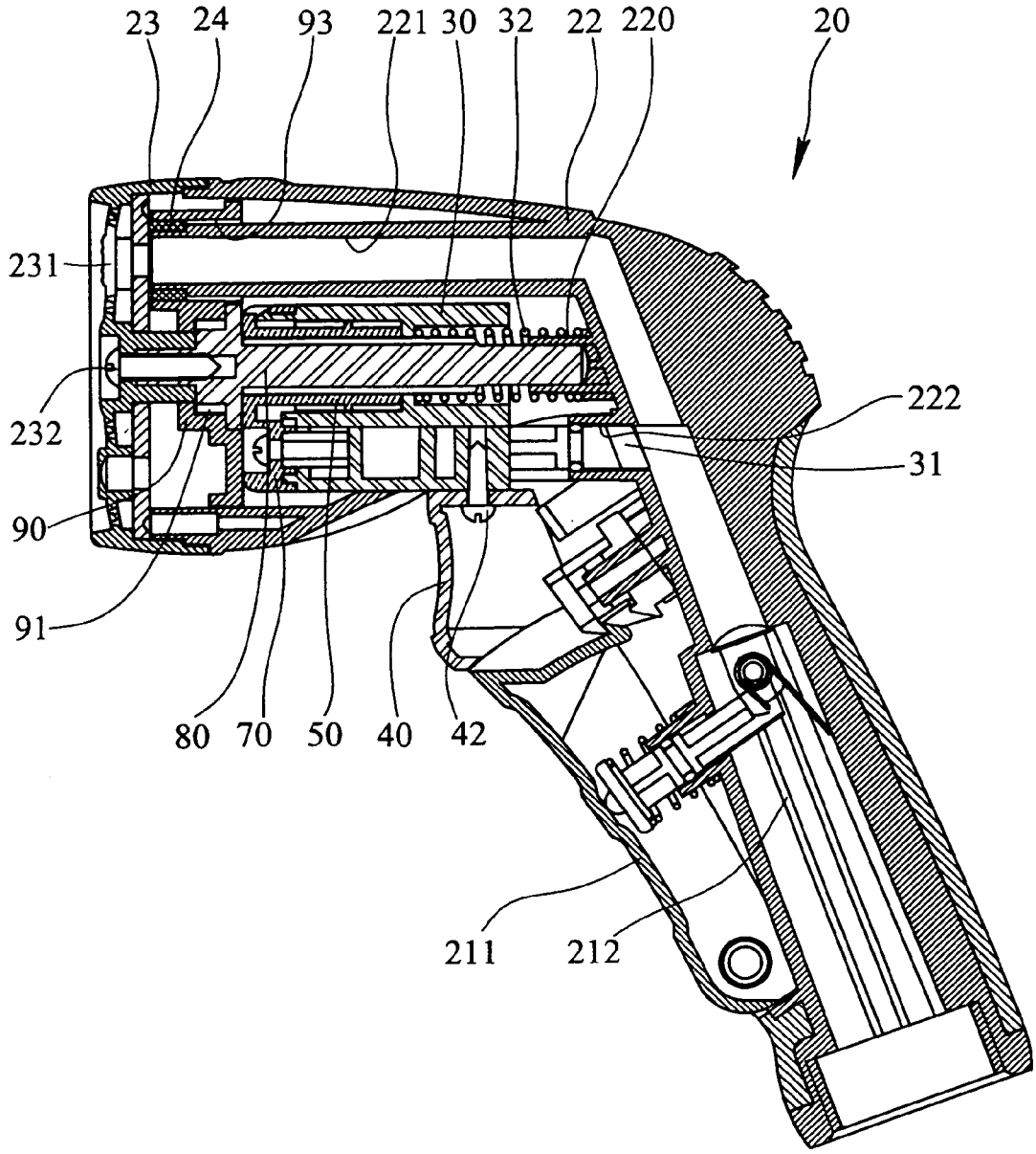
FIG. 4 is a side cross sectional view to show the garden nozzle of the present invention.

Referring to FIGS. 2 to 4 and 7A, the garden nozzle 20 of the present invention comprises a barrel 22 with a pipe 221 located therein and a handle 21 is connected to the barrel 22. A path 212 is defined through the handle 21 and the pipe 221 is in communication with the path 212 which is to be connected with a hose which is not shown. A trigger 211 is pivotably connected to the handle 21 and has a valve engaged with the path 212 so as to control the path 212 to allow water entering the path 212. A pattern switching button 40 is movably connected to the handle 21 and located above the trigger 211.

Figure 6:
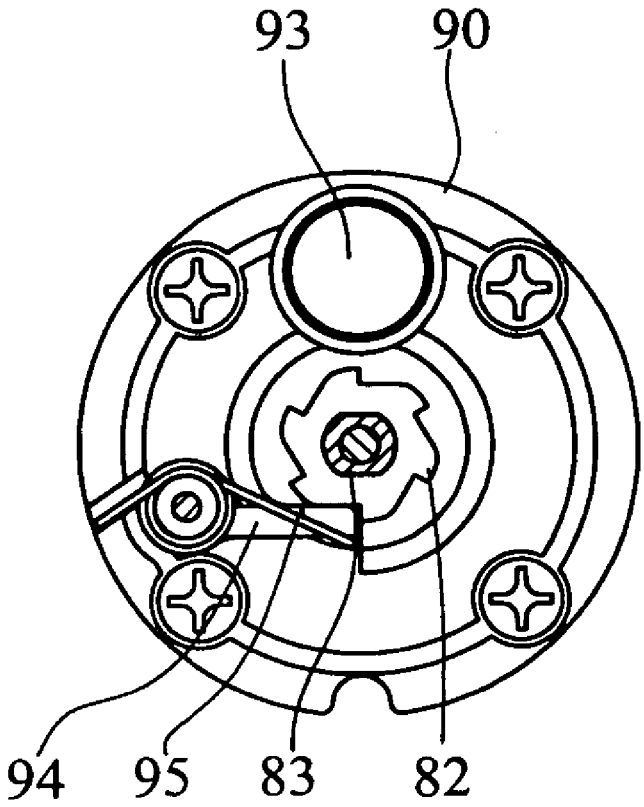
FIG. 6 shows the teeth on the shaft and the stop member.

A pattern member 23 is rotatably mounted to a front end of the barrel 22 and includes six pattern outlets 231 defined therethrough. A shaft 80 has a first end 83 fixed to the pattern member 23 by a screw 232 and a spiral groove 811 is defined in an outer periphery of a shank 81 of the shaft 80. The shank 81 located in the barrel 22 and a gear 82 comprising six teeth as shown in FIG. 6 is co-axially secured to the shank 81. The shank 81 extends through a disk 90, a central hole 71 in a frame 70, a passage 53 in a sleeve 50 which is received in a tube 30, and is rotatably received in a receiving portion 220 in the barrel 22. The disk 90 is located beside the pattern member 23 and fixed to the barrel 22 by extending several screws through holes in the disk 90 and fixed to connection tubes in the barrel 22. The shaft 80 extends through a central hole 92 in the disk 90. The disk 90 has a tubular portion 93 in which the pipe 221 in the barrel 22 is received and sealed by a seal ring 24. An annular recess 91 is defined the one side thereof so as that the gear 82 is rotatably received in the annular recess 91. A stop member 94 together with a torsion spring 95 are connected to the disk 90 and the stop member 94 is engaged with one of the teeth of the gear 82. The stop member 94 and the teeth of the gear 82 are shaped to have an inclined surface such that the gear 82 together with the shank 81 are allowed to be rotated in one direction.

The tube 30 is movably mounted to the shank 81 and a spring 32 is mounted to the shank 81 and the receiving portion 220, and biased between one end of the tube 30 and an inside of the barrel 22. Two holes 34 are defined through a wall of the tube 30 and a first pawl 60 and a second pawl 600 are respectively and pivotably engaged with the two holes 34 at two respective pivots 61 of the two pawls 60 and 600. The tube 30 includes a longitudinal extension 31 and the barrel 22 includes a guiding portion 222 therein, the longitudinal extension 31 movably inserted in the guiding portion 222. The pattern switching button 40 includes two lugs 41 which are connected to the tube 30 and a screw 42 extends through the pattern switching button 40 and fixed to the tube 30, such that when pulling the pattern switching button 40, the tube 30 moves backward therewith.

Figure 7A:
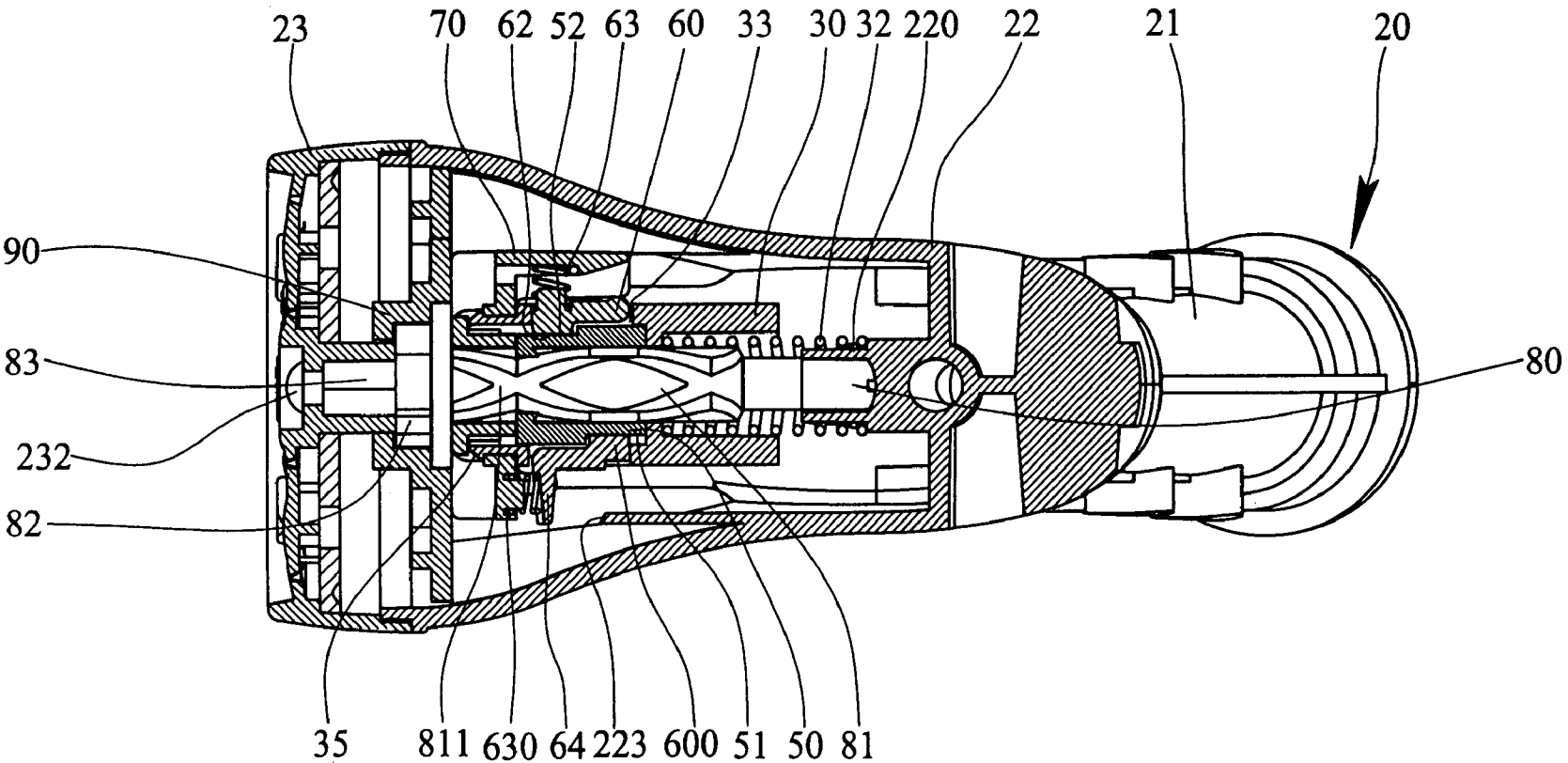
FIG. 7A is a top cross sectional view of the garden nozzle of the present invention.
Figure 7B:
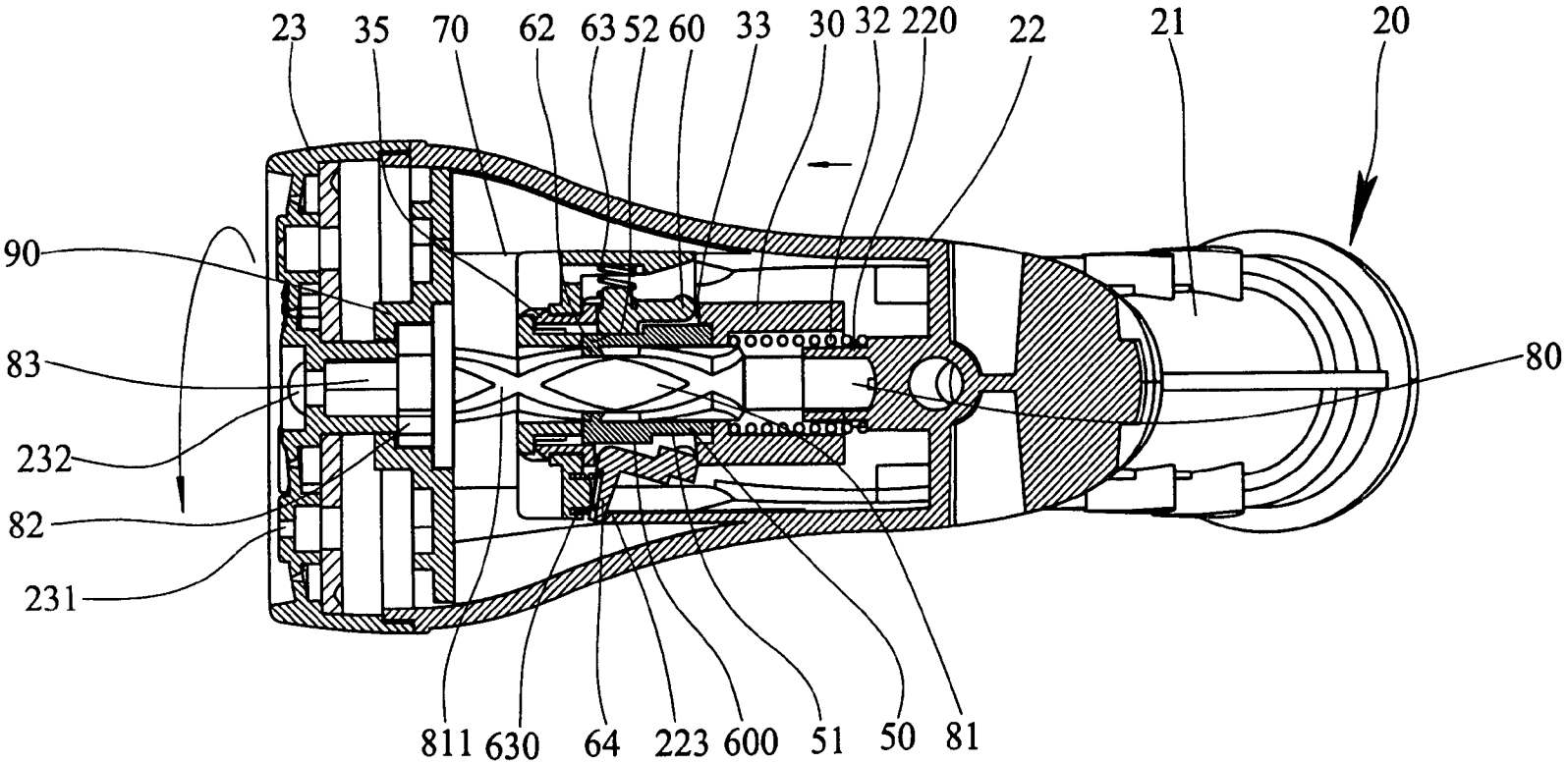
FIG. 7B is a top cross sectional view of the garden nozzle of the present invention when the pattern switching member is pulled.

The sleeve 50 is mounted to the shank 81 and located in the tube 30. A ridge 54 extends from an inner periphery of the sleeve 50 and is movably engaged with the groove 811 in the shank 81. Two recesses 51, 52 are defined in an outer periphery of the sleeve 50 and the first and second pawls 60, 600 each have a projection 62 which is engaged with the recess 51/52 corresponding thereto. By this way, the sleeve 50 cannot rotate relative to the tube 30. The second pawl 600 has a side wing 64 extending outward therefrom which may be pushed by a protrusion 223 in the barrel 22 to pivot the second pawl 600 away from the recess 52 when the tube 30 is moved backward as shown in FIG. 7B. The tube 30 further includes three insertions 35 extending from the other end thereof and the frame 70 includes two engaging notches 73 with which the three insertions 35 are engaged. A first positioning spring 63 is biased between the first pawl 60 and a side extension plate of the frame 70, a second positioning spring 630 is biased between the side wing 64 of the second pawl 600 and the rear surface 72 of the frame 70.

Figure 5:
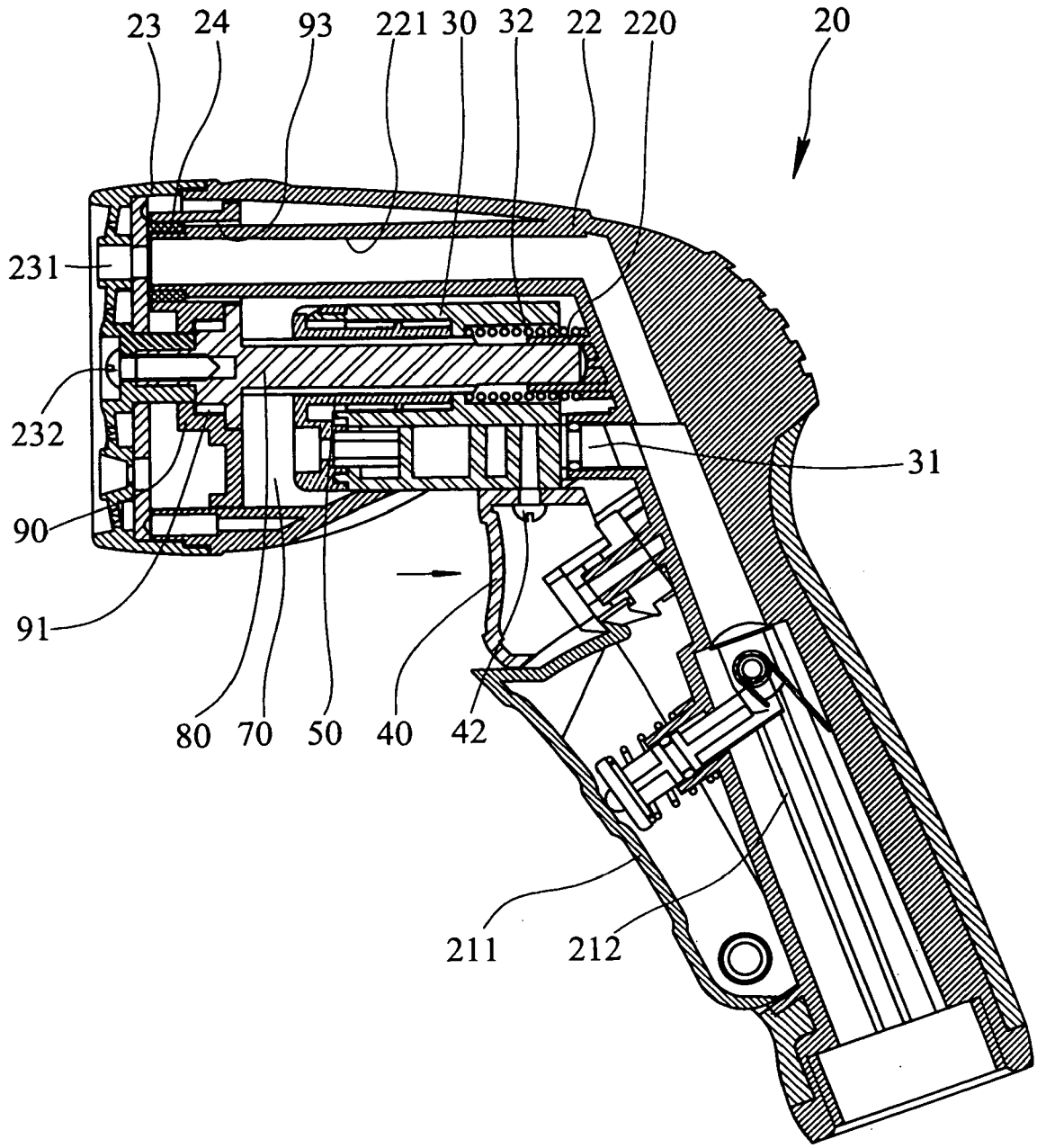
FIG. 5 is a side cross sectional view to show the garden nozzle of the present invention, wherein the pattern switching member is pulled.

As shown in FIGS. 5 and 7B, when pulling the pattern switching button 40, the tube 30 and the sleeve 50 which are secured by the two pawls 60, 600, are moved backward. The movement of the sleeve 50 rotates the shank 81 which drives the pattern member 23 to rotate 60 degrees which is the angle between two adjacent teeth of the gear 82. In other words, the user can operate the pattern switching button 40 by the hand holding the handle 21.

When releasing the pattern switching button 40, the spring 32 pushes the tube 30 together with the sleeve 50 forward and because the shaft 80 cannot rotate in opposite direction, the sleeve 50 and the tube 30 are rotated along the shaft 80 and back to their original position.

While we have shown and described the embodiment in accordance with the present invention, it should be clear to those skilled in the art that further embodiments may be made without departing from the scope of the present invention.

What is claimed is:

1. A garden nozzle comprising:

a barrel with a pipe located therein and a handle connected to the barrel and a path defined through the handle, the pipe connected with the path, a trigger pivotably connected to the handle and having a valve engaged with the path, a pattern switching button movably connected to the handle;

a pattern member rotatably mounted to a front end of the barrel and a shaft has a first end fixed to the pattern member and a spiral groove defined in an outer periphery of a shank of the shaft, the shank located in the barrel;

a tube movably mounted to the shank and a spring biased between one end of the tube and an inside of the barrel, two holes defined through a wall of the tube and a first pawl and a second pawl respectively and pivotably engaged with the two holes, the pattern switching button connected to the tube;

a sleeve mounted to the shank and located in the tube, a ridge extending from an inner periphery of the sleeve and movably engaged with the groove in the shank, two recesses defined in an outer periphery of the sleeve, and the first and second pawls engaged with the recesses respectively, the second pawl having a side wing extending outward therefrom which is pushed by a protrusion in the barrel to pivot the second pawl away from the recess.

2. The garden nozzle as claimed in claim 1 further comprising a disk located beside the pattern member and having a tubular portion in which the tube in the barrel is received, an annular recess defined the one side thereof, a gear co-axially secured to the shank and rotatably received in the annular recess, a stop member connected to the disk and engaged with one of the teeth of the gear, the stop member and the teeth of the gear being shaped that the gear together with the shank are rotated in one direction.

3. The garden nozzle as claimed in claim 2, wherein the gear includes six teeth.

4. The garden nozzle as claimed in claim 1, wherein the tube includes insertions extending from the other end thereof, a frame mounted to the shank and including two engaging notches with which the insertions are engaged, a first positioning spring biased between the first pawl and an extension plate of the frame, a second positioning spring biased between the side wing of the second pawl and the frame.

5. The garden nozzle as claimed in claim 1, wherein the tube includes a longitudinal extension and the barrel includes a guiding portion therein, the longitudinal extension movably inserted in the guiding portion.

6. The garden nozzle as claimed in claim 1, wherein the pattern switching button includes two lugs which are connected to the tube.

* * * * *